US009272226B2

(12) United States Patent
Samlaska

(10) Patent No.: US 9,272,226 B2
(45) Date of Patent: Mar. 1, 2016

(54) CONSTRUCTIBLE WATER TOY

(71) Applicant: Curt Samlaska, Henderson, NV (US)

(72) Inventor: Curt Samlaska, Henderson, NV (US)

( * ) Notice: Subject to any disclaimer, the term of this patent is extended or adjusted under 35 U.S.C. 154(b) by 51 days.

(21) Appl. No.: 14/270,359

(22) Filed: May 6, 2014

(65) Prior Publication Data

US 2015/0321111 A1 Nov. 12, 2015

(51) Int. Cl.

| | |
|---|---|
| ***A63H 33/12*** | (2006.01) |
| ***A63H 23/00*** | (2006.01) |
| ***A63H 33/06*** | (2006.01) |
| ***A63H 23/10*** | (2006.01) |

(52) U.S. Cl.

CPC ..... *A63H 23/005* (2013.01); *A63H 23/10* (2013.01); *A63H 33/06* (2013.01)

(58) Field of Classification Search

USPC ..... 446/85, 119–126, 176; 441/122–132

See application file for complete search history.

(56) References Cited

U.S. PATENT DOCUMENTS

| | | | | | |
|---|---|---|---|---|---|
| 2,609,638 | A * | 9/1952 | Lindenmeyer | A63H 33/107 | 285/125.1 |
| 3,148,539 | A * | 9/1964 | Cook | G09B 25/04 | 403/175 |
| 3,632,147 | A * | 1/1972 | Finger | A47F 5/14 | 403/171 |
| 4,274,222 | A * | 6/1981 | Zahn | A63H 33/102 | 124/5 |
| 4,358,866 | A * | 11/1982 | Rhodes | A47C 15/006 | 114/363 |
| 5,120,253 | A * | 6/1992 | Gelardi | A63H 33/10 | 446/109 |
| 5,318,470 | A * | 6/1994 | Denny | A63H 33/10 | 446/126 |
| 6,843,695 | B1 * | 1/2005 | Jackson | A61H 3/008 | 441/129 |
| 7,364,487 | B2 * | 4/2008 | Evans | A63H 33/008 | 446/108 |
| 8,403,723 | B1 * | 3/2013 | Haner | A63H 33/08 | 446/120 |

* cited by examiner

*Primary Examiner* — Nini Legesse

(74) *Attorney, Agent, or Firm* — Mark Huebscher; TechLaw LLP

(57) ABSTRACT

A constructible water toy for recreational use and learning, the water toy comprising a kit of parts having beams, connectors, and connector adapters. A beam comprises a pool noodle with a rigid endoskeleton support extending beyond the ends of the pool noodle. The endoskeleton support enables engagement to other beams via connectors or connector adapters with locking features for removably coupling the beams for forming endless structures.

6 Claims, 14 Drawing Sheets

CONSTRUCTIBLE WATER TOY

FIELD OF THE INVENTION

The present invention relates to a water toy, more particularly to a kit of parts for assembly into various structures.

BACKGROUND

Water toys entertain millions of children around the globe and are a significant constituent of revenue for the toy industry. Water toys enhance enjoyment of summer activities such as swimming, boating, or simply playing outside. Furthermore, many children do not attend school during the summer and need an outlet for a learning activity. One common learning activity is to build structures to improve certain analytical and motor skills. Toys geared toward this type or learning activity are not new in a playroom or classroom environment, but building a structure geared toward an aquatic environment is not known in the art. Thus, what is needed is a toy that combines the learning element from construction toys used in playroom and classroom environments with the playful nature of water toys used in an aquatic environment.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts as a prelude to the more detailed description that is presented later.

In one aspect of various embodiments, a kit of parts for a constructible water toy is provided, the kit comprising: a plurality of beams, each beam comprising a first end, a second end, and a tubular member having a hollow center cavity that extends through the length of the tubular member between the first end and second end of each beam; a plurality of endoskeleton supports each adapted to be disposed within each beam cavity, each endoskeleton support comprising a first end, a second end, and a cylindrical body joining the first end and second end of each endoskeleton support; and a plurality of connectors for removably engaging the plurality of endoskeleton support ends and enabling the plurality of beams to be joined together, the each connector having a center hub with at least one integrally formed protruding cylinder radially disposed about the center hub, wherein the plurality of beams, plurality of endoskeleton supports, and plurality of connectors are adapted to be joined together to erect a structure.

In one aspect of various embodiments, a kit of parts for a constructible water toy is provided, the kit comprising: a plurality of beams, the beams each comprising a first end, a second end, and a cylindrical body joining the first and second ends; a plurality of adapters for removably engaging the beam ends, the adapters each comprising a cylindrical body joining a primary end and a secondary end, wherein the body is bisected by a circumferential flange; and a plurality of connectors for removably engaging the adapter ends and the beam ends, thereby cooperating to enable a plurality of beams to be joined together, wherein the connectors each defined by a center hub with at least one integrally formed protruding cylinder radially disposed about the hub, wherein each of the connectors are interchangeable with the adapters for erecting a structure.

In one aspect of various embodiments, a method for assembling a kit of parts for a constructible water toy is provided, the method comprising: providing a kit of parts for a constructible water toy, the parts comprising a plurality of endoskeleton supports, a plurality of tubular beams, and a plurality of connectors; inserting an endoskeleton support into a beam end until each end of the support evenly protrudes beyond each beam end; deflecting a connector tang disposed in each end of the plurality of connectors; inserting the connector into a support end; and aligning the connector tang with a hole on a beam end, whereby a structure is erected by engaging the connectors to releasably attach into the ends of proximate supports thereby forming a releasably secure connection between the kit of parts.

DETAILED DESCRIPTION

In the following detailed descriptions of various embodiments, reference is made to the accompanying drawings that form a part hereof, and in which is shown, by way of illustration, specific embodiments that may be practiced. It is to be understood that other embodiments may be utilized and structural changes may be made without departing from the scope of the present disclosure.

Figure 1:
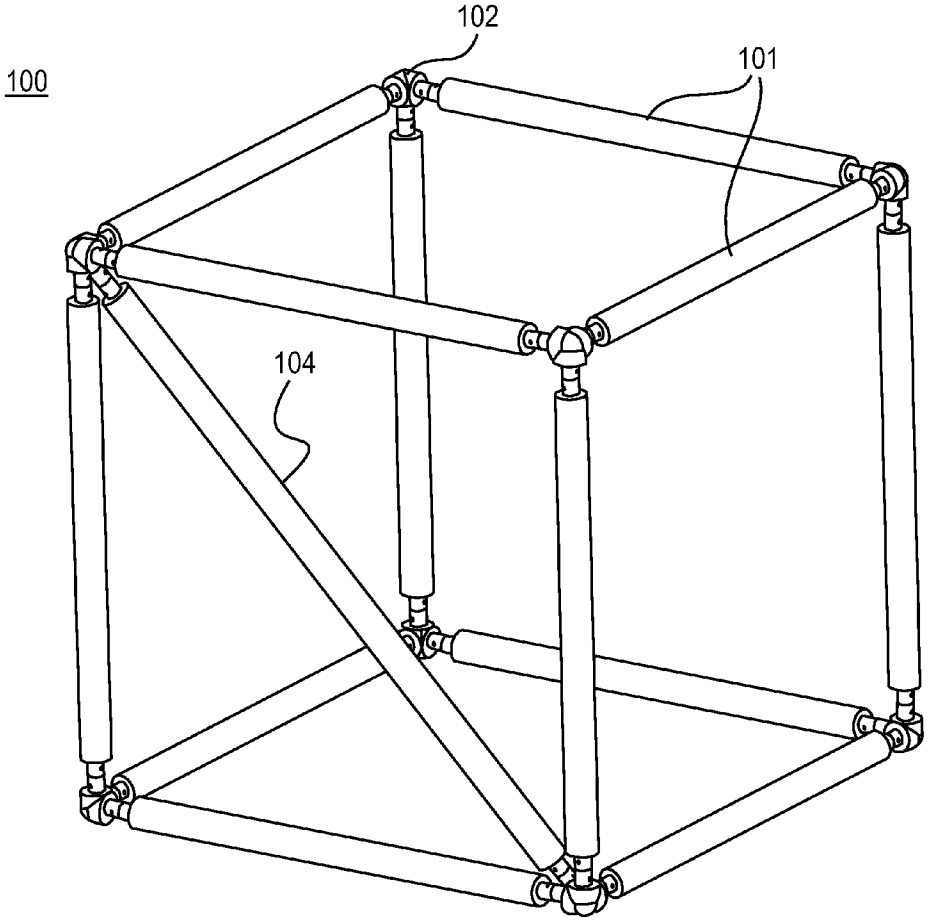
FIG. 1 is a perspective view of an embodiment constructible water toy.

FIG. 1 is a perspective view of an embodiment constructible water toy 100 with a multitude of configurations. Each configuration requires at least two components; a beam 101 and a connector 102, though other components may be contemplated and are contemplated later in the present disclosure. These components (101, 102) may be sold in kits of parts to facilitate the construction of different structures. Structure complexity is only limited by the number of components and the type of connectors, thus allowing the structure to take on a plurality of different forms.

The beam 101 may be provided with different lengths such as 1 foot, 2 feet, 4 feet, and so forth. Beam 101 lengths may also be non-integer fractions such as 2 feet 1⅝ inches and 4 feet 6 inches. Additionally, beam 101 lengths may be computed using the Pythagorean theorem in order to be provided with corner-to-corner spanning ability. For example, if two beams 101 that are each 4 feet in length are joined by a connector 102 having a 90 degree corner, then the corner-to-corner spanning beam 104 length must be the square root of $4^2+4^2$, which is approximately 5 feet 7⅞ inches. This corner-to-corner spanning beam 104 may also be referred to as a diagonal beam 104. Using this method, many permutations of lengths of beams 101, 104 are contemplated which may be sold as a kit or individually, along with connectors 102.

Figure 2:
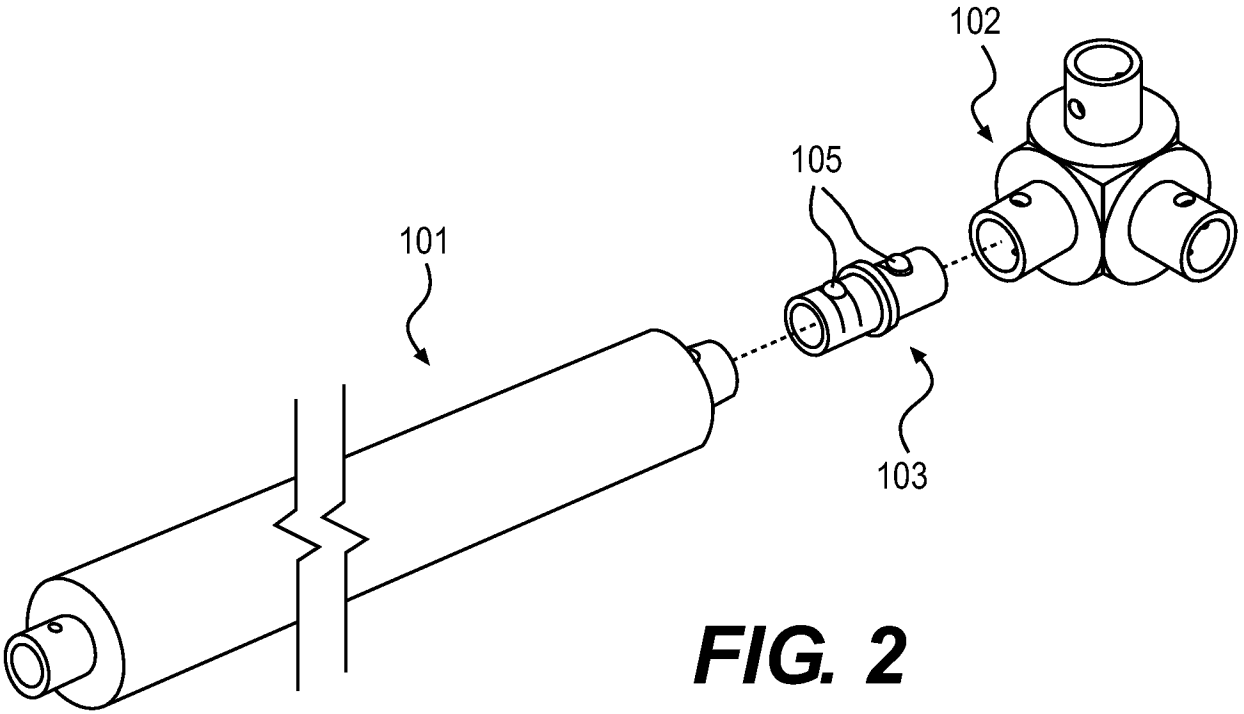
FIG. 2 is a partial exploded perspective view of FIG. 1.

Referring to FIG. 2, a partial exploded perspective view of FIG. 1 is shown. In an embodiment, the beam 101 and connector 102 may be joined with a connector link 103 (also referred to as a "connector adapter"). The link 103 may incorporate nubs 105 that hold the beam 101 and the connector 102 firmly together upon assembly, but allow the components (101, 102, 103) to be removed upon squeezing, twisting, pulling, and so forth. The link 103 may simplify the manufacture of the beam 101 and/or the connector 102 because, for example, if nubs 105 were placed on the ends of the beam 101 then it may be difficult to insert the endoskeleton support 302 into the outer tubular member 301 (each shown in FIG. 3). Furthermore, nubs 105 may be replaced with, or used in conjunction with, alternative forms of coupling such as pins, screws, tangs, and so forth.

In an embodiment, the nubs 105 may be placed on the one or more ends of the connector 102 so that they may engage with an end of the beam 101, thereby eliminating the need for a link 103. In another embodiment, the structure 100 may loosely be coupled together without a nub 105 or other coupling feature, thereby making a structure 100 held together via a friction fit where the parts fit snugly together and are restricted from movement. A friction fit may be accomplished used a tapered bore and tapered shaft combination, close-tolerance bore and shaft combination, and so forth.

Figure 3:
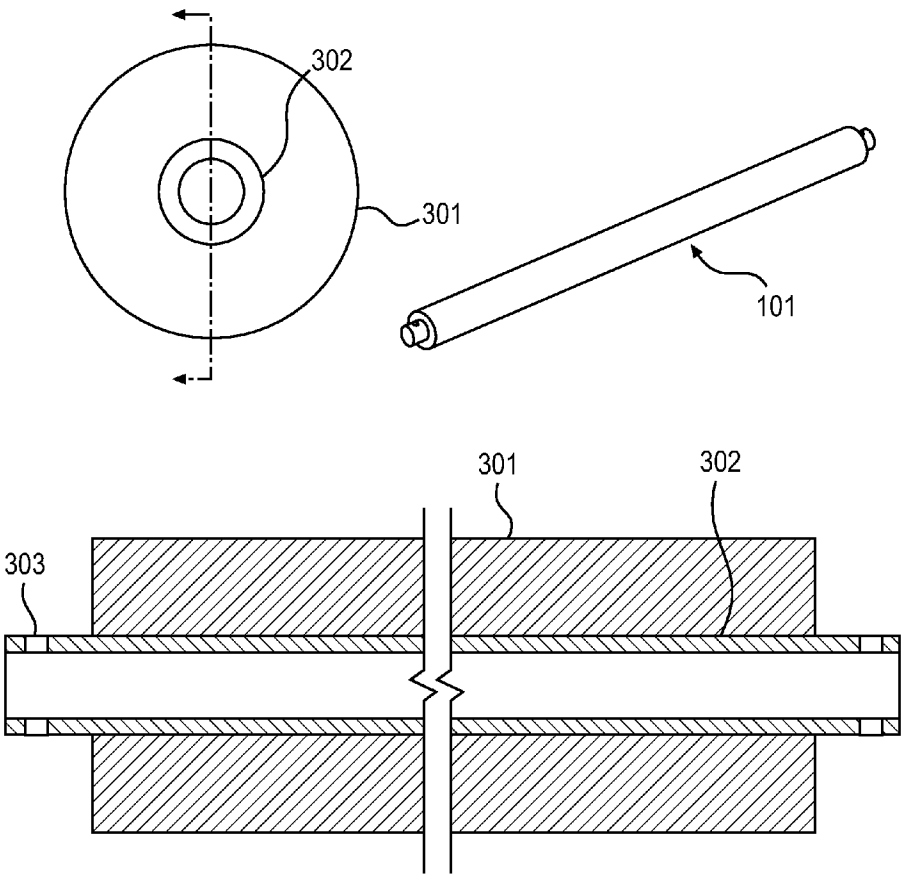
FIG. 3 is a perspective view, end view, and cross-section of an embodiment constructible water toy beam.

FIG. 3 is a perspective view, end view, and cross-section of an embodiment constructible water toy beam 101. The beam 101 may consist of an inner endoskeleton support 302 and an outer tubular member 301. The inner support 302 may be a tube, bar, or rod that has a cross-sectional shape that may conform to the inside diameter of the outer tubular member 301. The inner support 302 may be made of a material suitable for structural support yet lightweight enough for a toy that can be easily manipulated and float on water. High corrosion resistance may also be a concern due to its use in water. Such materials may be wood, fiberglass, polyvinylchloride (PVC), plastic, aluminum and so forth. The inner support 302 may be fabricated and then inserted from an end of the outer tubular member 301, and then pushed through the hollow center cavity with the support 302 ends evenly protruding beyond the tubular member 301 ends. Alternatively, the inner support 302 may be placed into an injection mold, and then have foam injected thereby surrounding and solidifying to create an outer tubular member 301 with an endoskeleton support 302. The tubular member 301 may be made from polyethylene foam, similar in characteristic to a pool noodle, water log, woggle, or the like. However, different foams may be employed to achieve different desired effects. Polystyrene, polyurethane, extruded polystyrene foam (XPS), and so forth may be used in addition to polyethylene which may have different densities by varying the size of the cells, or bubbles, in the foam. Foam density and/or material may be adjusted to increase or decrease buoyancy, hardness, stiffness, color, and so forth.

In an embodiment, the ends of the inner support 302 may have at least one hole 303 to engage a pin, screw, tang, nub, or the like in the connector 102 or the connector link 103. A hole 303 may be inserted radially and extend through either one or both walls of the tubular member 301. The hole 303 may be circular, square, trapezoidal, and so forth to allow easy insertion or removal of the connector 102 or connector link 103. The hole 303 may be placed sufficiently from the support 302 end to maximize strength and minimize insertion depth. In another embodiment, the center of the hole 303 may be located 0.50 inches from the end of the support 302.

Figure 4:
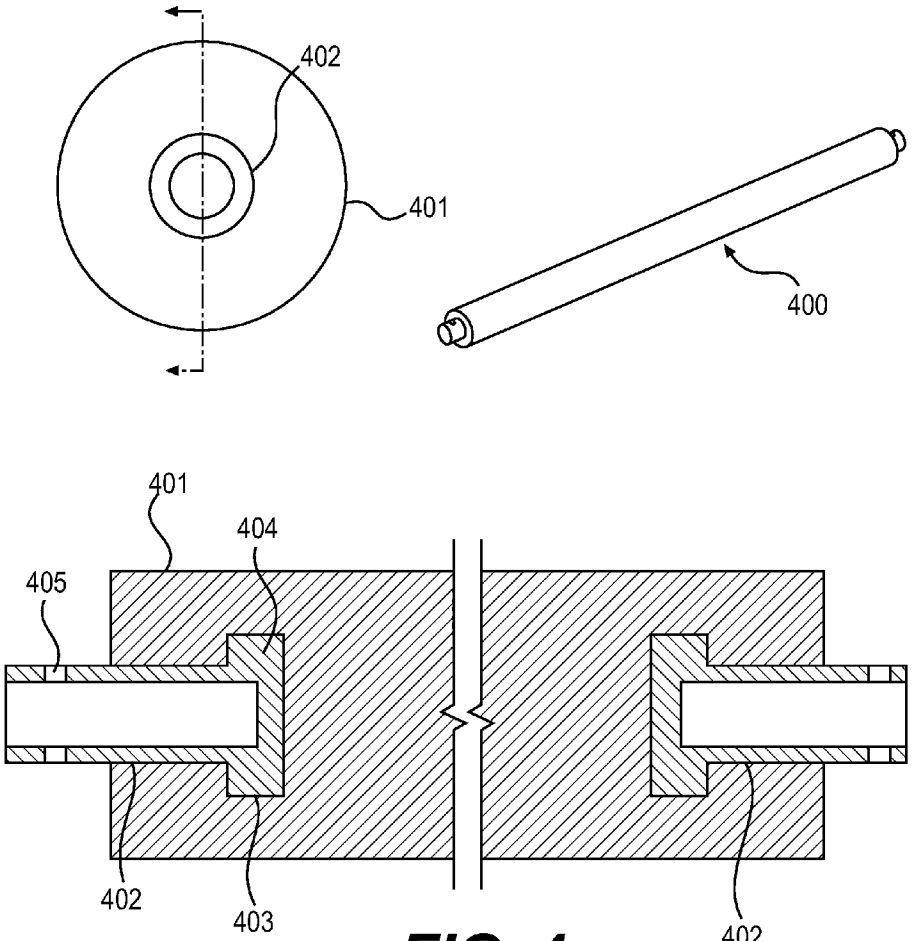
FIG. 4 is a perspective view, end view, and cross-section of another embodiment constructible water toy beam.

FIG. 4 is a perspective view, end view, and cross-section of another embodiment constructible water toy beam 400, which is similar to beam 101. The inner support 402 may not traverse the entire length of the beam 400. An inner support 402 may be inserted into an end or ends of the outer member 401, which may require the outer member 401 to provide the primary structural support for the beam 400. Alternatively, it may be advantageous to maintain flexibility in the outer member 401 to yield further variety in creating structures with rounded features such as domes, cones, cylinders, spheres, and so forth. As in other embodiments described herein, the outer member 401 may be made from polyethylene foam. The foam may be tinted with various colors for variety, or the foam may be tinted to designate different characteristics such as rigidity or hardness. For example, if a beam 400 were colored red, then it may be used as a stiff, straight structural element. Whereas, if the beam 400 were colored green, then it may be flexible in order to form a rounded structure.

In an embodiment, the inner support 402 may comprise a barb 403 or other such retaining structure or device in order to prevent easy removal of the inner support 402 from the outer member 401. Other shapes of the barb 403 are contemplated than what is shown in FIG. 4 to effectuate a robust retention structure or device, including, but not limited to, a plurality of hooks or a triangular annulus. As noted above, the inner support 402 may be inserted into the ends of the outer member 401, or the outer member 401 may be formed around the inner support 402 such as through an injection mold process. As in beam 101, the ends of the support 402 may evenly protrude beyond the ends of the outer member 401. An end cap 404 may be advantageous to facilitate the injection mold process by disallowing the foam into the inner cavity of the inner support 402. Additionally, the end cap 404 may be rounded or pointed to facilitate insertion of the inner support 402 into an end of the outer member 401.

Figure 5:
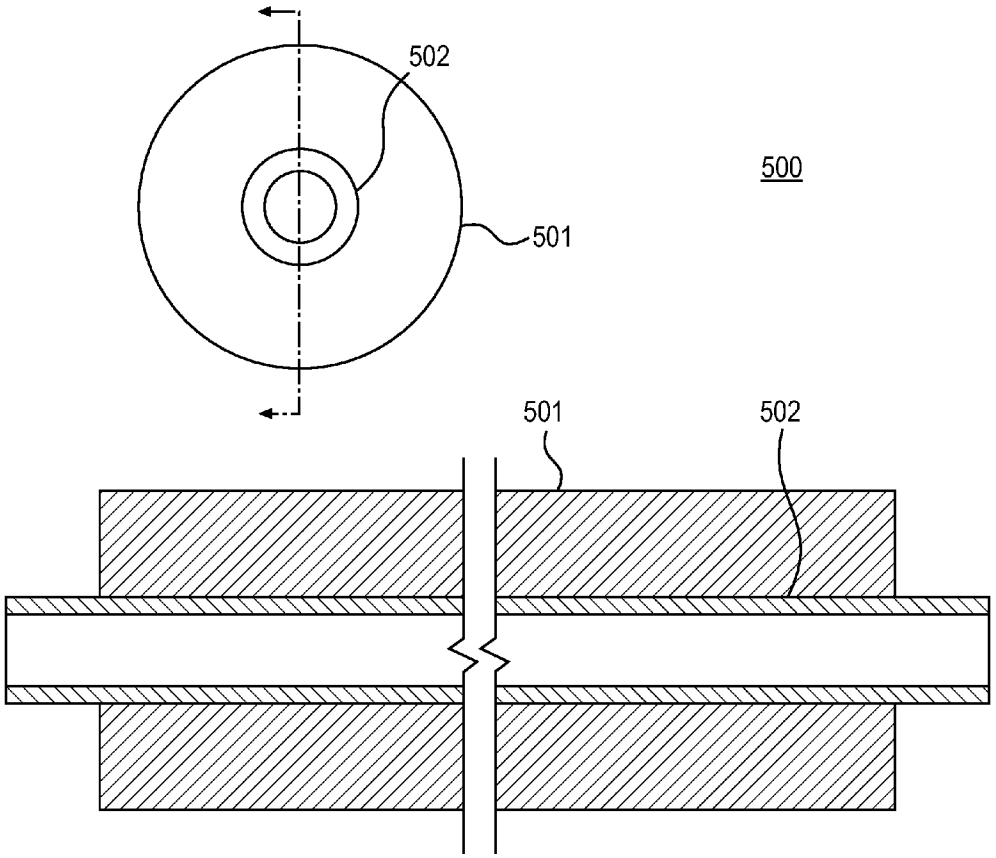
FIG. 5 is an end view and cross-section of still another embodiment constructible water toy beam.

FIG. 5 is an end view and cross-section of still another embodiment constructible water toy beam 500, which is similar to beam 101. An endoskeleton support 502 is disposed within a soft outer member 501. The outer member 501 may be identical in all respects to a traditional pool noodle, which may be a polyethylene foam round tube with a hollow, axial center cavity. The endoskeleton support 502 may be a hollow tube to save weight, save material, and so forth. As in other embodiments described herein, the ends of the support 502 may evenly protrude beyond the ends of the outer member 501.

Figure 6:
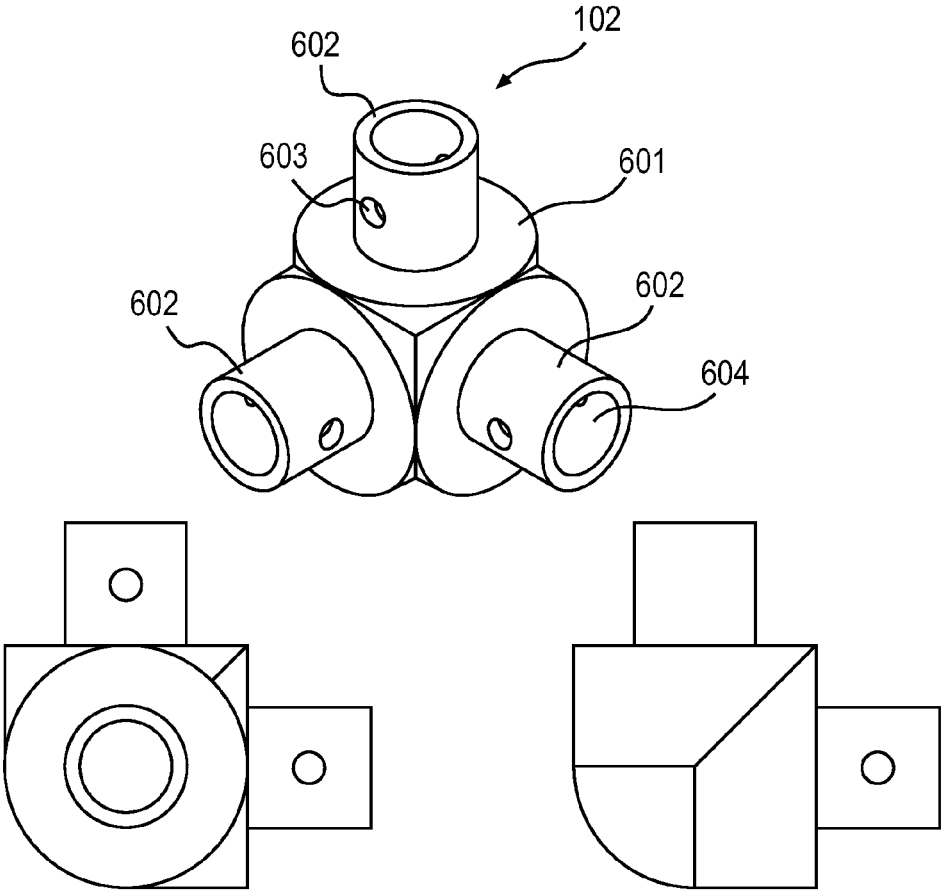
FIG. 6 is a perspective view, right side view, and front view an embodiment constructible water toy connector.

FIG. 6 is a perspective view, right side view, and front view of an embodiment constructible water toy connector 102. The connector 102 is illustrated with three couplers 602 for receiving three beams 101 or three connecting links 103. However, a connector 102 may have many different coupler 602 permutations including 1 through n couplers. Additionally, the angle between each of the couplers 602 is not restricted to 90 degrees, and may be greater than or less than 90 degrees. One such use for a connector 102 with a coupler 602 angled other than 90 degrees may be to create a roof apex. Couplers 602 may be made of a material suitable for structural support yet lightweight enough for a toy that can be easily manipulated and float on water. Such materials may be wood, fiberglass, polyvinylchloride (PVC), plastic, aluminum, and so forth.

In an embodiment, the connector 102 may be at least partially surrounded with a protector 601 made of polyethylene foam or similar material. In addition to cushioning for safety reasons, the protector 601 may provide additional buoyancy for the connector 102, and/or aesthetic appeal.

In another embodiment, the connector may have central bores 604 placed in the couplers 602. With a hollow center, the coupler 602 may engage the end of the beam 101 or the link 103 by sliding over the outside of the coupler 602. Alternatively, the coupler 602 may engage the beam 101 or link 103 by sliding inside the bore 604, thus giving making the hollow center advantageous for minimizing the use of material or to simplify manufacture. At least one hole 603, which may be disposed perpendicular to the coupler 602 center axis, may be used to engage a locking feature on the beam 101 or link 103 such as a pin, screw, tang, nub, and so forth.

Figure 7:
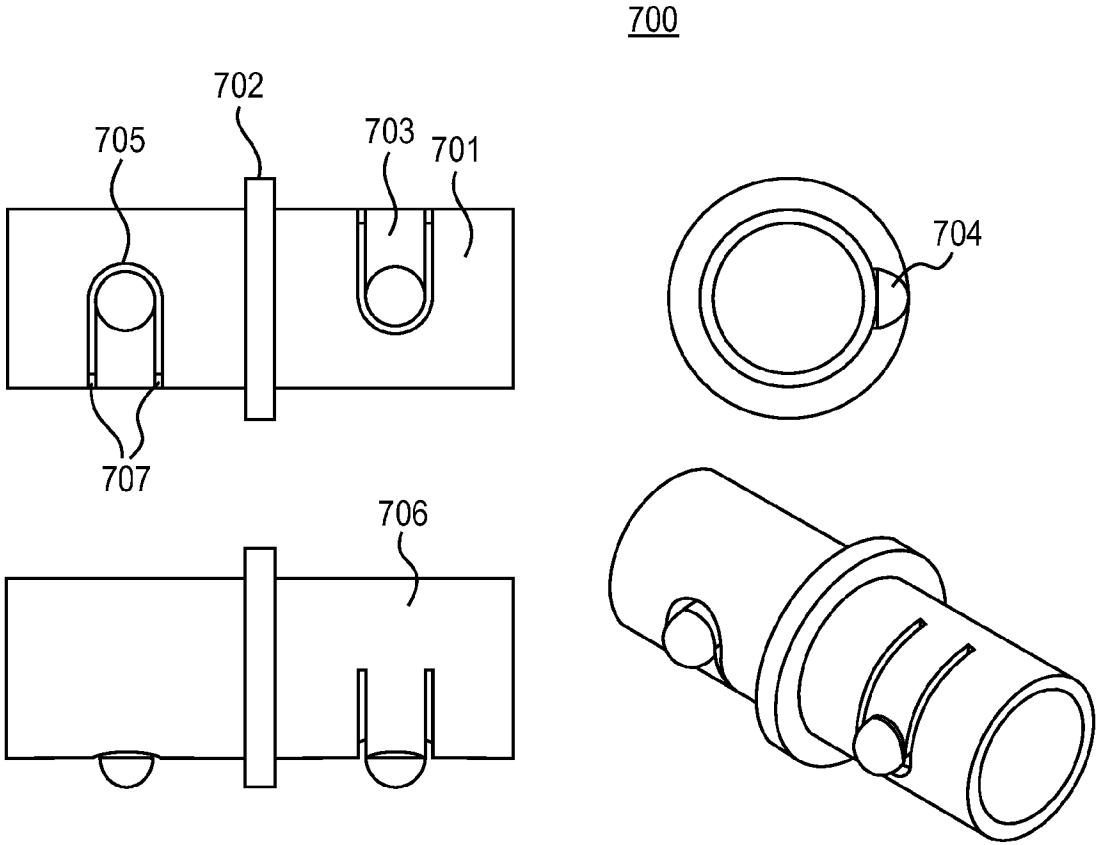
FIG. 7 is a perspective view, right side view, front view, and bottom view of an embodiment constructible water toy connector adapter.

In still another embodiment, a bendable tang with a hemispherical nub, also referred to as a locking tang, similar to the embodiment of such feature shown in FIG. 7, may be placed on one or more couplers 602 of the connector 102 to releasably secure the connector 102 to the beam 101 or link 103.

FIG. 7 is a perspective view, right side view, front view, and bottom view of an embodiment constructible water toy connector adapter 700. The adapter 700 may have a hollow tubular cylinder 701 bisected by a larger diameter cylinder travel limiter 702, or circumferential flange. The circumferential flange 702 may limit the connector 102 or beam 101 engagement length. At least one locking tang 703 may be formed into the circumference of the cylinder 701. The locking tang 703 may be cantilevered with an end joined to the cylinder 701 at a vertex 706 in order to permit radial deflection. Inward deflection may allow the nub 704 to internally pass through the end of a beam 101 or connector 102, and then snap into one or more holes 303, 405, 603. When pressing or otherwise deflecting the locking tang 703 and nub 704 inward, deformation of the tang 703 may begin at the vertex 706. The tang 703 may be created by forming a gap 705, 707 into the tubular cylinder around the perimeter of the tang 703. The gap 705, 707 width may be more or less than illustrated to permit free movement of the tang 703 and nub 704. The gap 705 near the nub 704 and the gap 707 may be different dimensions, particularly because bending of the tang 703 may cause the nub 704 to interfere with the tubular cylinder 701.

In an embodiment, the nub 704 may not be hemispherical and instead may be shaped as a triangular ramp (not shown) to permit disengagement of the adapter 700 from a beam 101 or connector 102 through a twisting action. In another embodiment, a bendable tang with a hemispherical nub, similar to the embodiment of such feature shown in FIG. 7, may be placed on one or more couplers 602 of the connector 102 to releasably secure the connector 102 to the beam 101 or link 103.

Figure 8:
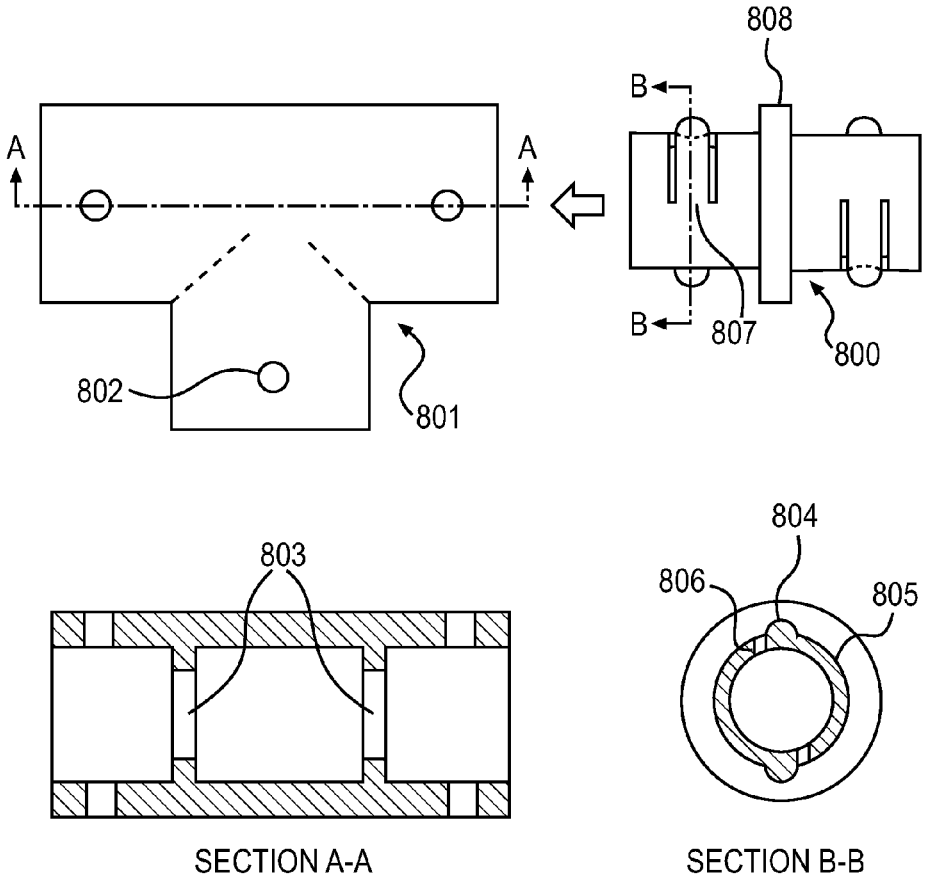
FIG. 8 is a top view of an embodiment constructible water toy connector, a connector adapter, and cross-section of a connector adapter.

FIG. 8 is a top view of an embodiment constructible water toy connector, a cross-section of a connector, a connector adapter, and cross-section of a connector adapter. The connector adapter 800 is shown being inserted into the connector 801. The cylindrical outer diameter of the adapter 800 may engage the cylindrical inner diameter of the connector 801. Nubs 804 on the adapter 800 may be depressed radially inward to engage at least one hole 802 located near the end of the connector 801. Elastic yielding of the material may allow at least one cantilevered tang 805 to bend at the vertex 807, thus allowing the nub 804 to radially deflect. Upon insertion of the adapter 800 into the connector 801, axial engagement of the adapter 800 may be limited by internal collars 803, illustrated in Section A-A, or by an external collar 808.

In an embodiment, the nubs 804 may be hemispherical to allow a user to twist the connector adapter 800 for disengagement. The twisting action, which may be applied about the center longitudinal axis of the adapter 800, may deflect the tang 805 and cause axial depression of the nub 804. The direction of twist, as viewed in Section B-B, may be in the clockwise direction. Though, if the tang 805 were reversed to the opposite side of the cylinder, then the direction of twist may be counterclockwise. A perimeter cutout 806 surrounding the nub 804 and tang 805 may be larger than illustrated to permit unimpeded radial deflection. For example, if a plastic material were chosen and if the outer diameter of the adapter 800 is 0.950 inches, the inner diameter is 0.800 inches, the nub 804 height is 0.200 inches, then the cutout 806 may be 0.125 inches. This particular combination of dimensions is provided merely as an example. Many dimensional combinations of features may be employed to suit various aspects of the structural design such as rigidity, ease of assembly, ease of disassembly, ruggedness, overall weight, buoyancy, and so forth.

Figure 9:
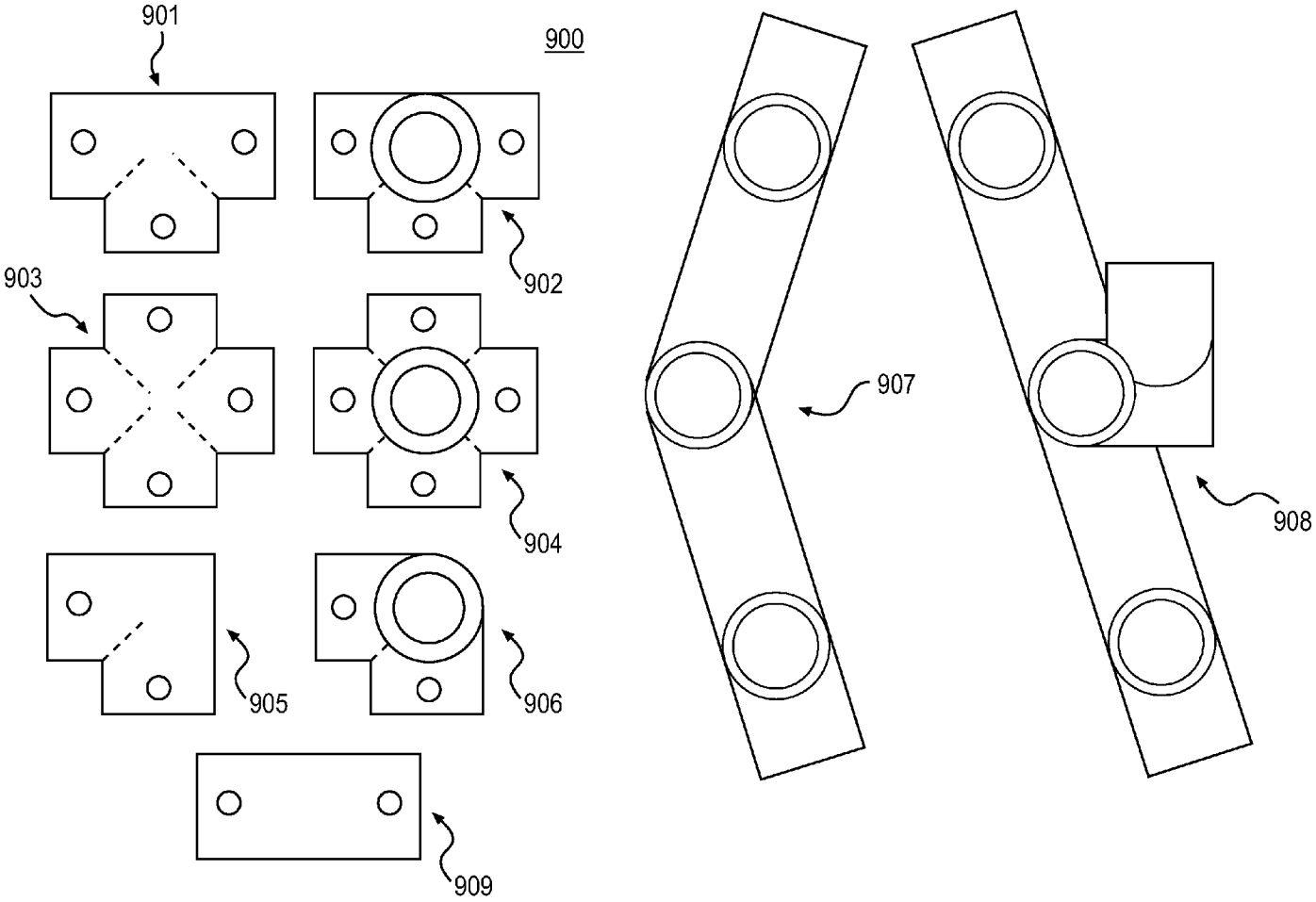
FIG. 9 is a top view of various embodiments of water toy connectors.

FIG. 9 is a top view of various embodiments of water toy connectors 900, which are similar to 102. It is, of course, not possible to show all possible embodiments of the connectors 900 and, thus, are not limited to the various permutations. For example, connectors 900 may have 1 through n possible connections. Thus, the embodiments of connectors 901 through 909 are intended to show some possible variations. The connectors 900 shown are able to engage a beam 101 and/or a connector link 103. A connector 900 with a single connection (not shown) may be placed on a beam 101 end as a stylistic feature, a protective feature, or the like. The connectors 900 may be at least partially surrounded with a soft covering, such as foam, to match the outer member of the beam 101. For example, a connector (not shown) with a single connection may have a foam sphere disposed about an end opposite the connection. This type of connector may be characterized as a beam end cap, or capping means, because a beam 101, connectors 900, or connector links 103 are disallowed after a single-ended connector (not shown) is inserted into a beam 101. Furthermore, the connectors 900 may have holes disposed near the ends of the couplers to releasably engage a beam 101 and/or a connector link 103.

In an embodiment, the connectors 900 may have connector tangs (shown as 703, 805), instead of holes 802, for directly engaging the holes 303, 405 in the ends of the beams 101, 400. The outer diameter of the connectors 900 may be adapted to fit the inside diameter of the ends of the beams 101, 400.

Figure 10:
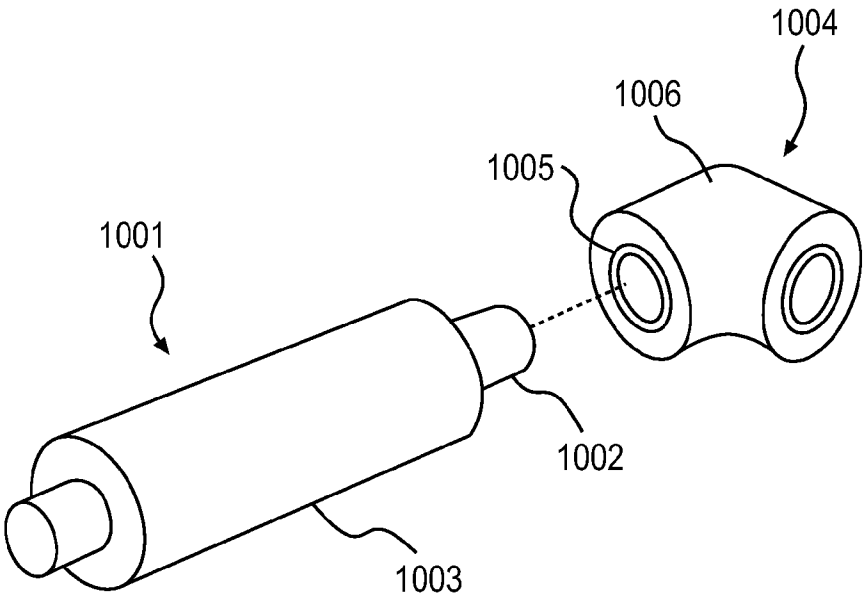
FIG. 10 is partial exploded perspective view of another embodiment constructible water toy.

FIG. 10 is partial exploded perspective view of another embodiment constructible water toy. An embodiment beam 1001, which is similar to beam 101, is illustrated as having a solid, inner cylindrical supporting rod 1002, similar to an endoskeleton, with an outer tubular member 1003. The rod 1002 may engage a connector 1004 through a friction fit, threaded joint, or the like. The connector 1004, which is similar to connectors 900, may have an internal support 1005 to enhance stability upon assembly into a water toy structure. As in other embodiment described herein, the connector 1004 may have a soft outer covering 1006 for aesthetic appeal, safety, and so forth.

Figure 11:
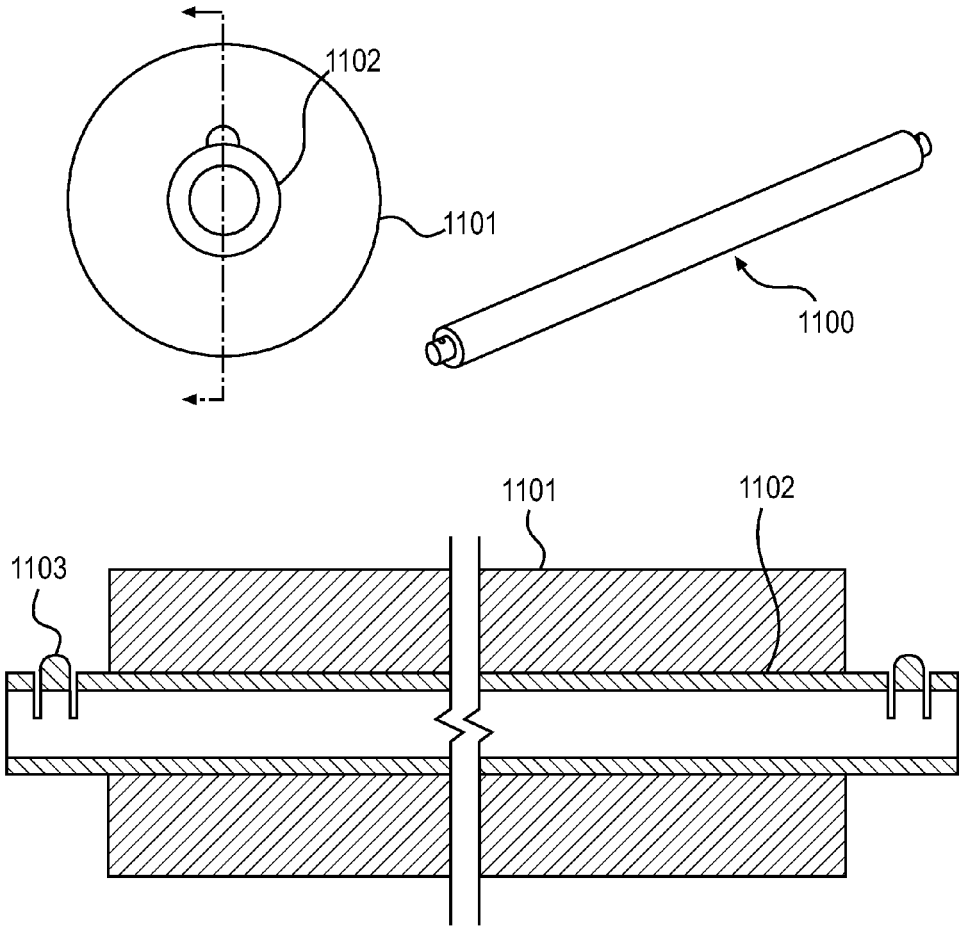
FIG. 11 is a perspective view, end view, and cross-section of yet another embodiment constructible water toy beam.

FIG. 11 is a perspective view, end view, and cross-section of yet another embodiment constructible water toy beam 1100, which again, is similar to 101. As previously mentioned, at least one nub 1103 may be placed on an end of an endoskeleton support 1102 to engage a connector 102, as illustrated in FIG. 6. With the nub 1103 placed on the end or ends of the beam 1100, then connectors 900 may be used without the connector adapter 103, 700, 800 because the nub 1103 may engage one or more holes in the ends of the beam 1100.

Figure 12:
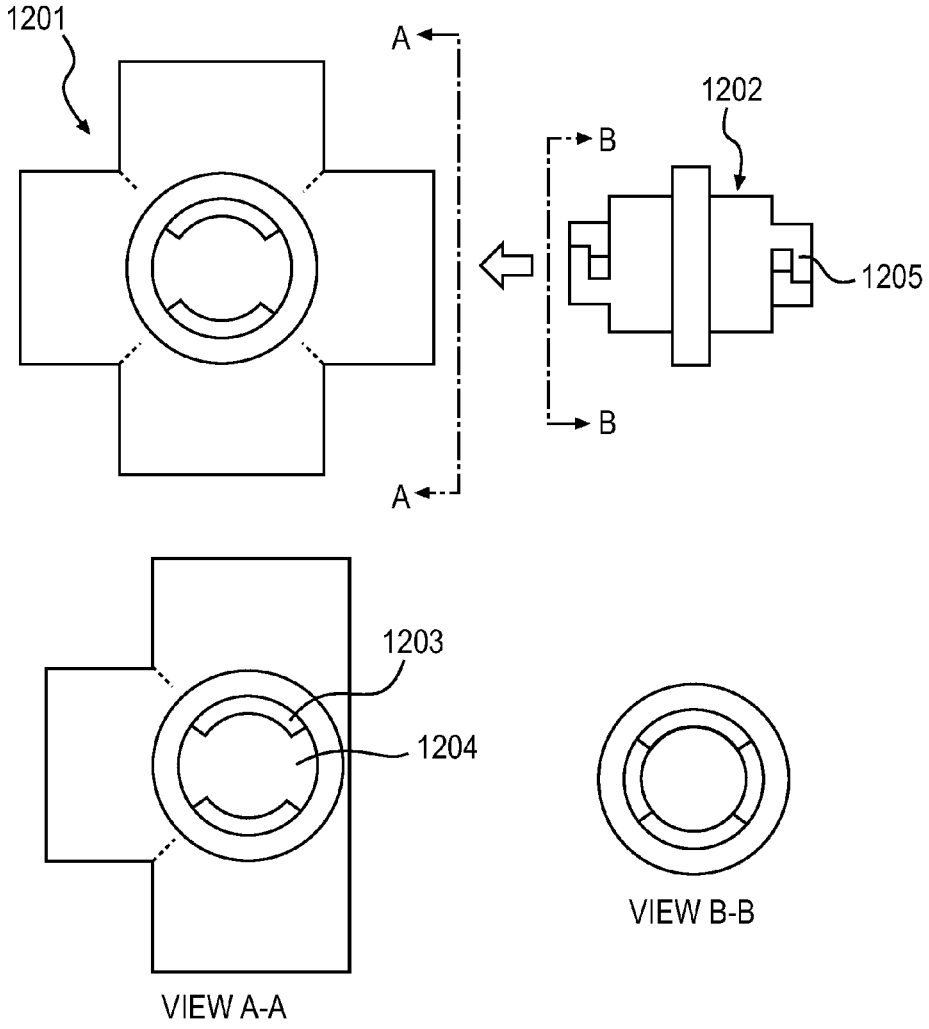
FIG. 12 is a top view of an embodiment constructible water toy connector, a connector adapter, and end views of each.

FIG. 12 is a top view of an alternate embodiment constructible water toy connector 1201, a connector adapter 1202, and end views of each. These components 1201, 1202 illustrate a different coupling scheme than connector adapter 800 and connector 801. In an embodiment, the adapter 1202 may have at least one L-shaped hook 1205 to removably engage a corresponding bifurcated collar 1203 within an end of the connector 1201. The L-shaped hook 1205 may slide through an opening 1204 between a bifurcated collar 1203 and then, upon twisting the adapter 1202, may engage the collar 1203 to prevent accidentally disengaging the adapter 1202 from the connector 1201.

In another embodiment, a plurality of L-shaped hooks 1205 may be disposed onto an end of an adapter 1202. A plurality of openings 1204 may be placed within the collar 1203 to accept the plurality of hooks 1205. A similar hook and collar configuration may be employed at the connection between an adapter 1202 and a beam (not shown).

Figure 13:
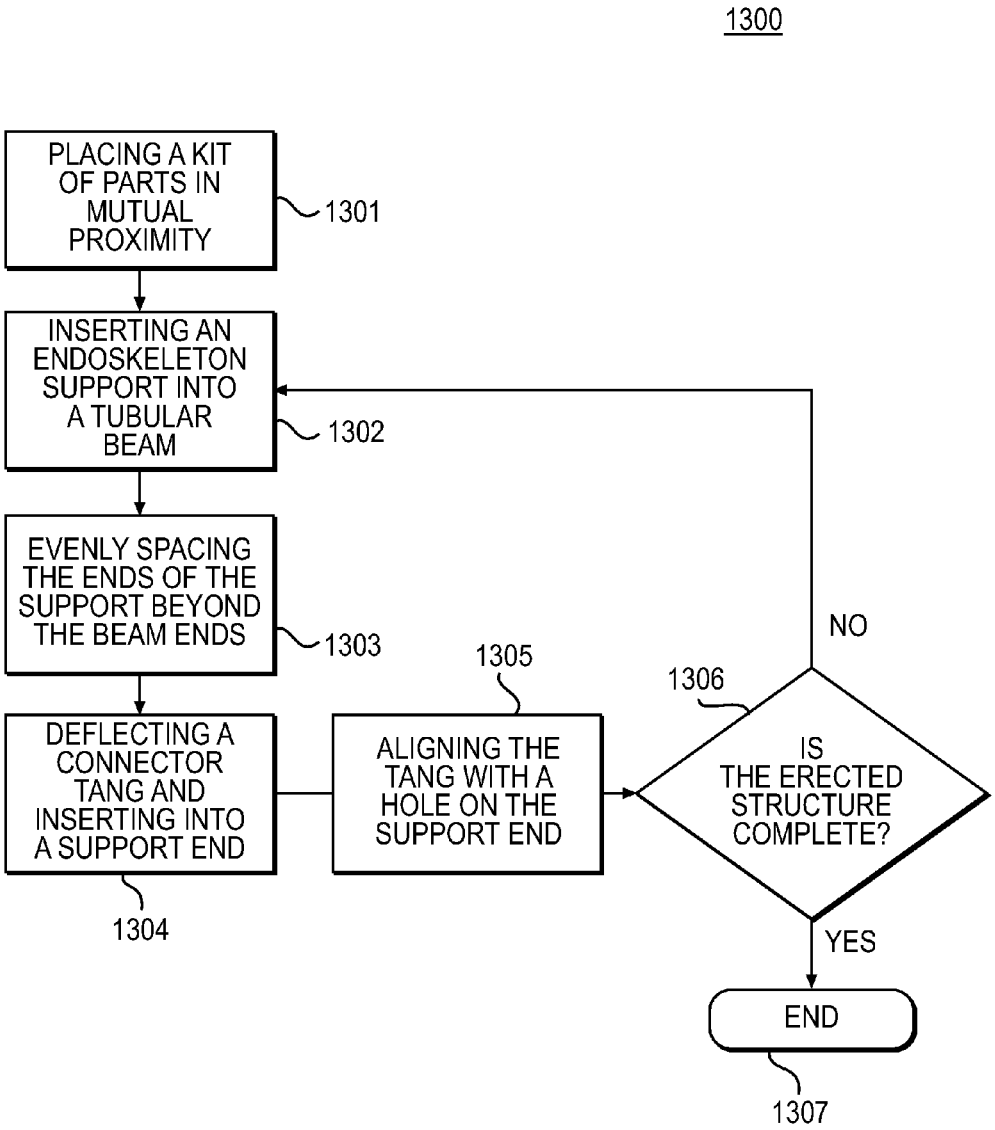
FIG. 13 is a flow chart of an example method for constructing a water toy kit of parts.

FIG. 13 is a flow chart for constructing a water toy kit of parts. In an embodiment, the process 1300 may begin with placing parts of a kit in mutual proximity (step 1301) to each other. A beam 101 may then be formed (step 1302) by inserting an endoskeleton support 302 into a tubular beam 301 (step 1303). Then, a connector (or connector adapter) tang 805 may be deflected and a connector adapter 700, 800 inserted into an end of the endoskeleton support 302 (step 1304). The tang 805 may then be aligned with a hole 303 on the support 302 end by twisting, pulling, or and/pushing the connector adapter 700, 800 (step 1305). Alternatively, a connector 900 or another beam 101 may be inserted onto the opposite end of the connector adapter 700, 800. The user makes a decision at this point to determine whether or not the erected structure is complete (step 1306). If not complete, then steps 1302 through 1305 may be repeated. If the erected structure 100 is complete, then the process is complete (step 1307).

Figure 14:
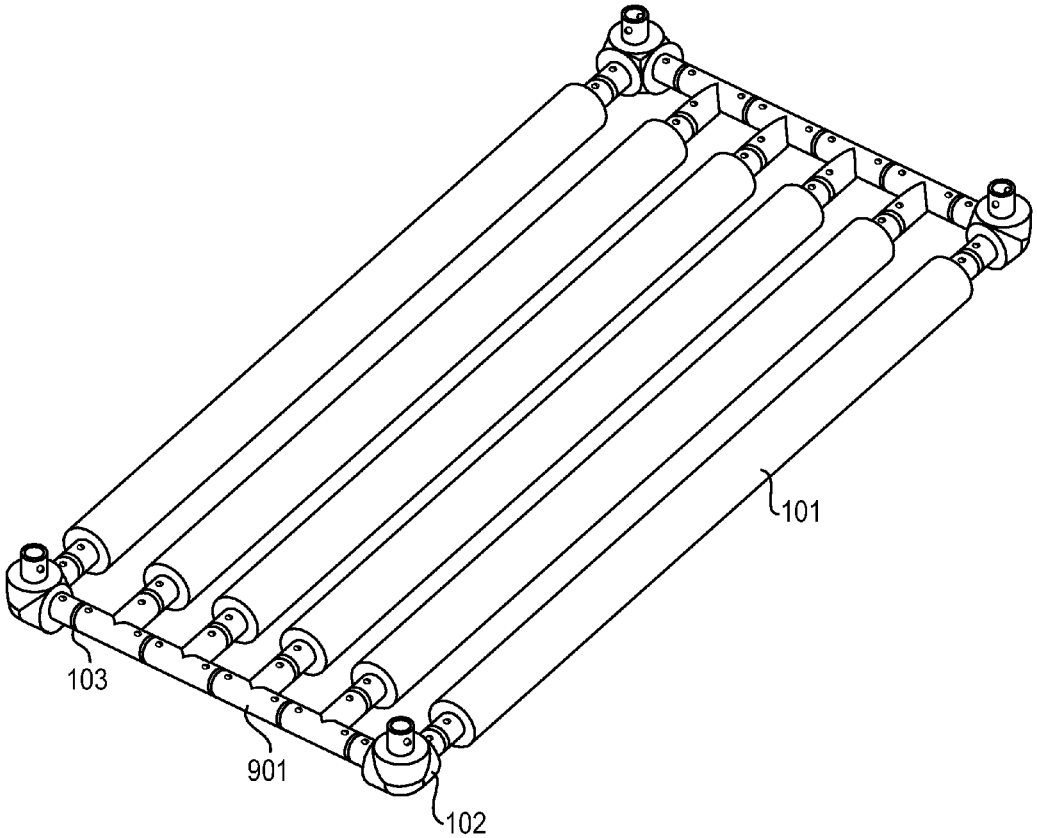
FIG. 14 is a perspective view of another embodiment constructible water toy.

FIG. 14 is a perspective view of another embodiment constructible water toy. A plurality of beams 101 may be joined together in parallel via connectors 901, connector adapters 103, and connectors 102. In the embodiment illustrated, the beams 101 may act as a base for a floating structure such as a raft.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A kit of parts for a constructible water toy, comprising:

a plurality of beams, each beam comprising a first end, a second end, and a tubular member having a hollow center cavity that extends through the length of the tubular member between the first end and second end of each beam;

a plurality of endoskeleton supports each adapted to be disposed within each beam cavity, each endoskeleton support comprising a first end, a second end, and a cylindrical body joining the first end and second end of each endoskeleton support, wherein the first and second support ends extend beyond the first and second beam ends, and wherein the first and second ends have at least one hole radially formed into the first and second ends of the support, and wherein the at least one hole is formed at a predetermined length from the first and second ends of the support; and a plurality of connectors for removably engaging the plurality of endoskeleton support ends and enabling the plurality of beams to be joined together, each connector having a center hub with at least one integrally formed protruding cylinder radially disposed about the center hub, wherein the plurality of beams, plurality of endoskeleton supports, and plurality of connectors are adapted to be joined together to erect a structure, the protruding cylinder from each of the connectors further comprising at least one locking tang formed from a portion of each of the connectors at least one protruding cylinder, wherein the locking tang is cantilevered to permit radial deflection, whereby the locking tang engages the at least one hole in a springing action to removably secure the connector and support, and wherein the at least one locking tang further comprises a dome-shaped nub outwardly protruding from an outer surface of the tang, whereby the nub engages the at least one hole.

2. The kit of parts according to claim 1, wherein the plurality of beams are pool noodles, each beam having a predetermined length.

3. The kit of parts according to claim 1, wherein each of the connectors protruding cylinder is tubular for engaging with the endoskeleton support ends and whereby the connectors are retained inside the endoskeleton support ends.

4. The kit of parts according to claim 1, further comprising a circumferential flange formed into a portion of the connector's at least one protruding cylinder, whereby the flange limits the connector engagement length.

5. A kit of parts for a constructible water toy, comprising:

a plurality of tubular beams, the beams each comprising a first end, a second end, and a cylindrical body joining the first and second ends, wherein the first and second beam ends further comprise a connector support molded within the first and second beam ends to form a single beam element, and wherein the connector support on each end further comprises at least one hole radially formed into the first and second ends, and wherein the at least one hole is formed at a predetermined length from the ends of the support;

a plurality of adapters for removably engaging the beam ends, the adapters each comprising a cylindrical body joining a primary end and a secondary end, wherein the body is bisected by a circumferential flange, and wherein the body further comprises at least one locking tang formed from a portion of the cylindrical body, wherein the locking tang is cantilevered to permit radial deflection, whereby the locking tang engages the at least one hole in a springing action to removably secure the connector and support, the tang further comprising a dome-shaped nub outwardly protruding from the at least one locking tang, whereby the nub engages the at least one support end hole; and a plurality of connectors for removably engaging the adapter ends and the beam ends, thereby cooperating to enable a plurality of beams to be joined together, wherein the connectors are each defined by a center hub with at least one integrally formed protruding cylinder radially disposed about the hub, the protruding cylinders further comprising at least one hole radially formed into each of the protruding ends of the connectors, wherein the hole is formed at a predetermined length from the ends of the support wherein each of the connectors are interchangeable with the adapters for erecting a structure.

6. The kit of parts according to claim 5, wherein the plurality of beams are pool noodles, each beam having a predetermined length.

* * * * *